US009961970B2

(12) United States Patent
Boutherin et al.

(10) Patent No.: US 9,961,970 B2
(45) Date of Patent: May 8, 2018

(54) WATCH AND BAND THEREOF

(71) Applicant: AFFORDANCES, Annecy le Vieux (FR)

(72) Inventors: Nicolas Boutherin, Alex (FR); Richard Piras, Pringy (FR)

(73) Assignee: AFFORDANCES, Annecy le Vieux (FR)

( * ) Notice: Subject to any disclaimer, the term of this patent is extended or adjusted under 35 U.S.C. 154(b) by 0 days. days.

(21) Appl. No.: 15/323,707

(22) PCT Filed: Jul. 2, 2015

(86) PCT No.: PCT/FR2015/051838
§ 371 (c)(1),
(2) Date: Feb. 1, 2017

(87) PCT Pub. No.: WO2016/001598
PCT Pub. Date: Jan. 7, 2016

(65) Prior Publication Data

US 2017/0164699 A1 Jun. 15, 2017

(30) Foreign Application Priority Data

Jul. 4, 2014 (FR) ..... 14 56422

(51) Int. Cl.
*G04B 37/14* (2006.01)
*A44C 5/14* (2006.01)

(52) U.S. Cl.
CPC ..... *A44C 5/145* (2013.01); *G04B 37/1486* (2013.01)

(58) Field of Classification Search
CPC ..... G04G 9/04; G04G 9/042; G04G 9/047; A44C 5/145; G04B 37/1486; G04B 37/14
See application file for complete search history.

(56) References Cited

U.S. PATENT DOCUMENTS 4,396,298 A * 8/1983 Ripley ..... G04B 37/0058 368/276
4,456,384 A * 6/1984 Murakami ..... G04B 37/0008 368/10
4,571,199 A * 2/1986 Murakami ..... G04B 37/0008 446/135

(Continued)

OTHER PUBLICATIONS

Lever—wikipedia.org—Jan. 18, 2018.*

*Primary Examiner* — Sean Kayes
(74) *Attorney, Agent, or Firm* — Hershkovitz & Associates, PLLC; Abe Hershkovitz

(57) ABSTRACT

A watch constituted by a case carried by a band, the case fastened on the band by a removable connection constituted by the interaction of two elements, a first element fastened on the band and a second element integral with the case. One of the elements is a hooking element while the other element is a locking element comprising a movable bolt biased by a resilient system, coupling it to the hooking element. The hooking element is constituted by a slider that interacts with a slide rail in the locking element, while the movable bolt comprises a locking projection engaged into a recessed profile on the slider. The movable bolt mounted in the locking element pivotingly around an axis is a class 1 lever including a first arm comprising the locking projection and a second arm biased by unlocking means.

20 Claims, 5 Drawing Sheets

(56) References Cited

U.S. PATENT DOCUMENTS

| | | | | |
|---|---|---|---|---|
| 6,502,981 | B2 * | 1/2003 | Haida | A44C 5/14 368/276 |
| 7,526,840 | B2 * | 5/2009 | Pernu | A44C 5/14 24/265 WS |
| 7,618,260 | B2 * | 11/2009 | Daniel | A44C 5/0007 24/311 |
| 8,235,585 | B2 * | 8/2012 | Speichinger | G04B 37/1486 224/177 |
| 9,523,965 | B2 * | 12/2016 | Liao | G04G 17/06 |
| 9,785,121 | B2 * | 10/2017 | Brown | G04F 10/00 |
| 2016/0324470 | A1 * | 11/2016 | Townsend | G06F 1/163 |

* cited by examiner

WATCH AND BAND THEREOF

The present invention relates to an improvement for a watch and band thereof. It relates in particular to the fastening of the case to the band.

Watches are made up of a case bearing a dial, either for time or to present other information such as altitude, temperature, et cetera. In the past, watch cases were carried by a chain connected to clothing, but for a long time watch cases have been worn on users' wrists using a band generally comprising a clasp.

For a very long time, designers have been satisfied with a single approach: specifically, and for the great majority of instances, the watch case is fastened to the ends of two band regions by transverse rods called "spring pins." There has been no evolution with regard to this principle, even though customers are eager for novelty and especially for modularity and personalization.

The present invention proposes an entirely novel device allowing the user to uncouple the case of his or her watch from the band without using a tool, while leaving the band around his or her wrist.

The watch thus comprises a case carried by a band; according to the invention, the case is fastened on the band by a removable connection, the latter being constituted by the interaction of two elements, namely a first element fastened on the band and a second element integral with the case; one of the elements is a hooking element while the other element is a locking element comprising a movable bolt biased by a resilient system, coupling it to the hooking element; the hooking element is constituted by a slider intended to interact with a slide rail implemented in the locking element, while the movable bolt comprises a locking projection intended to be engaged into a recessed profile implemented on the slider, while the movable bolt is mounted in the locking element pivotingly around an axis, said bolt being a class 1 lever constituted by a first arm comprising the locking projection and a second arm intended to be biased by unlocking means.

In addition, depending on the preferred embodiment, the interaction of the slider with the slide rail is of the dovetail type, while the slider of the hooking element comprises a substantially rectangular first portion, that first portion interacting with the slide rail of the locking element, said slider comprising a conically shaped second portion intended to interact with a corresponding conical cutout implemented in the locking element.

Note that the locking element comprises an inner receptacle forming the slider and its conical stabilization and insertion portion, and a lateral cutout in which the movable bolt is received. Note also that the central portion of the bolt is guided in a circular receptacle in order to ensure pivoting thereof around the axis.

The unlocking means are constituted by a resilient bow, one end of which is immobilized in the locking element and the other end of which comprises an unlocking actuation projection intended to abut against the second arm of the bolt.

The bow is furthermore constituted by a circular part made of elastically deformable material.

The watch is such that the locking element comprises a pushbutton projecting out of that locking element to allow easy actuation by the user, who in order to unlock and release the case simply needs to press down in order to cause pivoting of the movable bolt, said pushbutton being arranged in abutment against that end of the bow at which the unlocking actuation projection is located.

According to one of the embodiments, the locking element is integral with the case while the hooking element is integral with the band.

According to another embodiment, the locking element is integral with the band while the hooking element is integral with the case.

In addition, the band is a flexible strip in a single piece, the ends of which interact with the aid of a clasp.

Other characteristics and advantages of the invention will be apparent from the description that follows, referring to the attached drawings which are provided merely as non-limiting examples.

Figure 1:
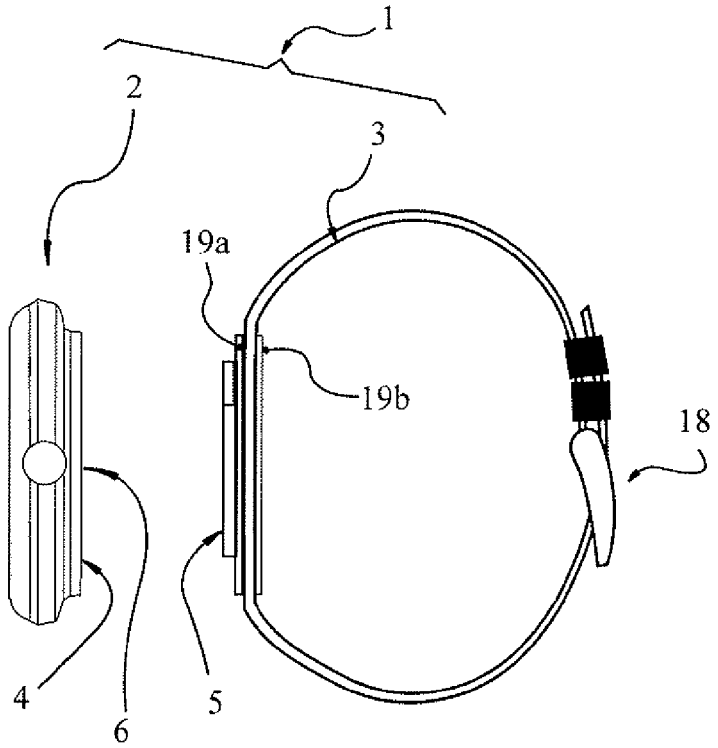
FIG. 1 is an illustration depicting the watch, the band not being equipped with the watch case.
Figure 2:
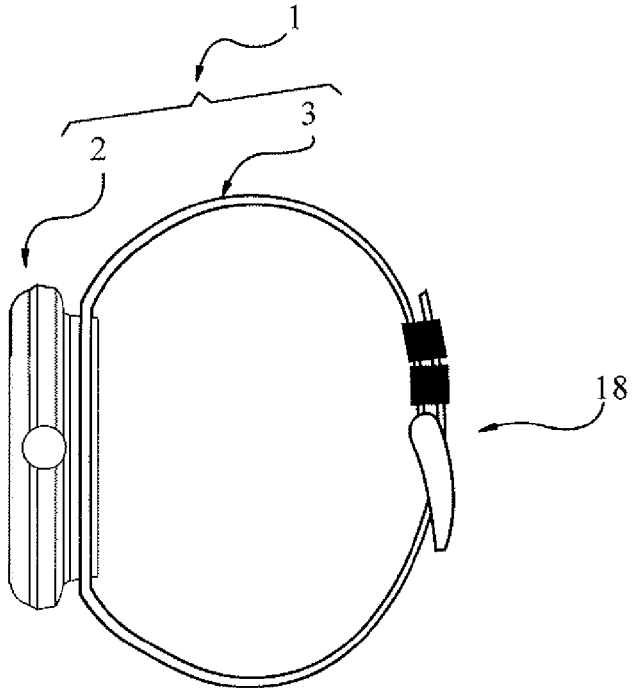
FIG. 2 is an illustration depicting the watch, the band being equipped with the watch case.

Watch 1 according to the invention comprises, in known fashion, a case 2 carried by a band 3. The latter is constituted by a strip intended to surround the user's wrist. The band can be of any type, for example a strap made of leather, metal, rubber, et cetera, such as a textile.

According to the invention, back 4 of case 2 is fastened removably on band 3. For that purpose, fastening means for the case are implemented by way of a removable connection.

The fastening means are constituted by the interaction of two elements 5, 6, namely a first element 5 fastened on band 3 and a second element 6 fastened on the case, more particularly on back 4 of the case. The element can, of course, be the case itself.

Note that one of the elements, which will be called a "hooking element," is the one onto which the other element, which will be called a "locking element," is removably fastened.

The locking element comprises at least one movable bolt 7 comprising a projection 8 intended to engage into a recessed profile 9 implemented on the hooking element.

Said projection 8 of movable bolt 7 is biased into the locked position by a resilient system 10 such as a spring. Movable bolt 7 is mounted movably in the locking element so as to occupy two positions, i.e. a locked position (FIG. 7) in which locking projection 8 is engaged into recessed profile 9 of the other, hooking element, and an unlocked position (FIG. 6) in which disengagement of the projection exists, allowing the two elements to be uncoupled.

Interaction between the two elements occurs thanks to a slide rail system. The hooking element thus comprises a slider 11 while the other, locking element comprises a slide rail 12 into which the slider is inserted.

Movable bolt 7 is mounted in the locking element pivotingly around an axis 15, said bolt being a Class 1 lever constituted by a first arm 7*a* comprising the locking projection and a second arm 7*b* intended to be biased by the unlocking means.

Figure 6:
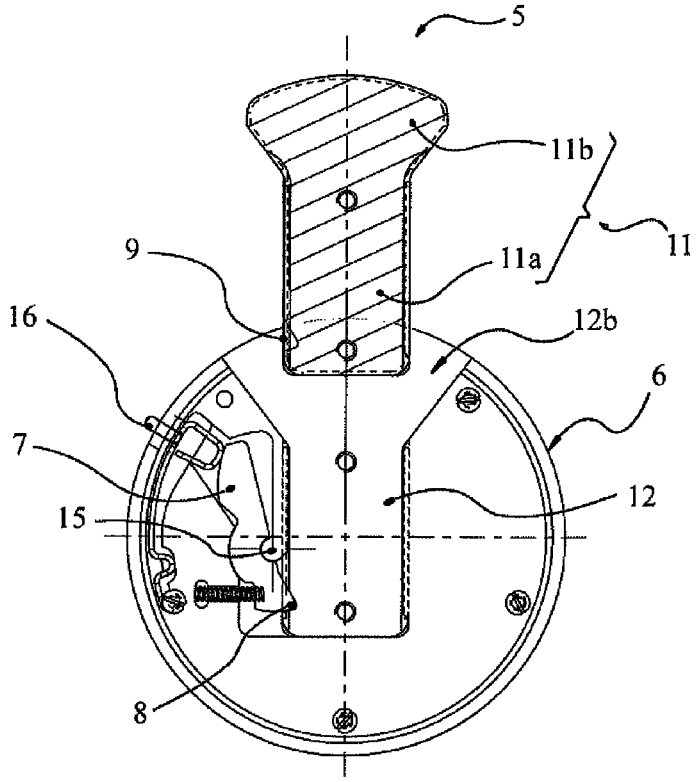
FIG. 6 depicts the unlocked position of the case with respect to the band.
Figure 7:
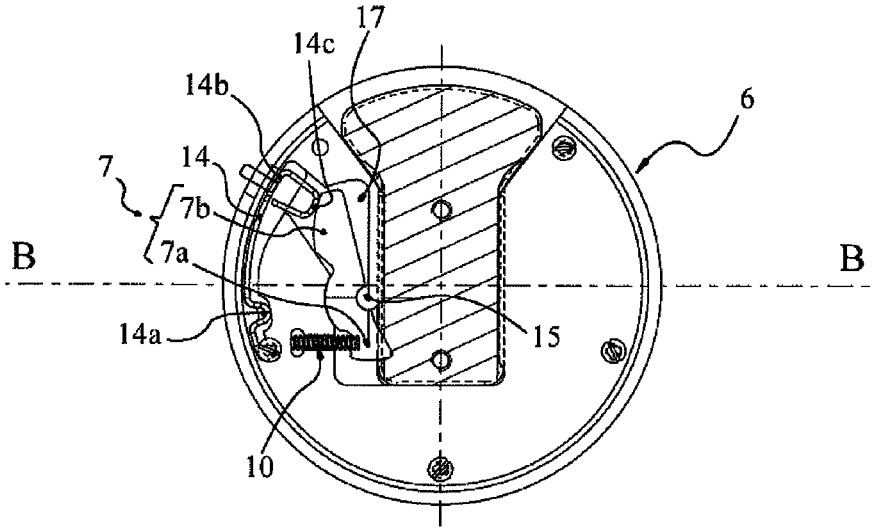
FIG. 7 illustrates the locked position of the case with respect to the band.
Figure 8:
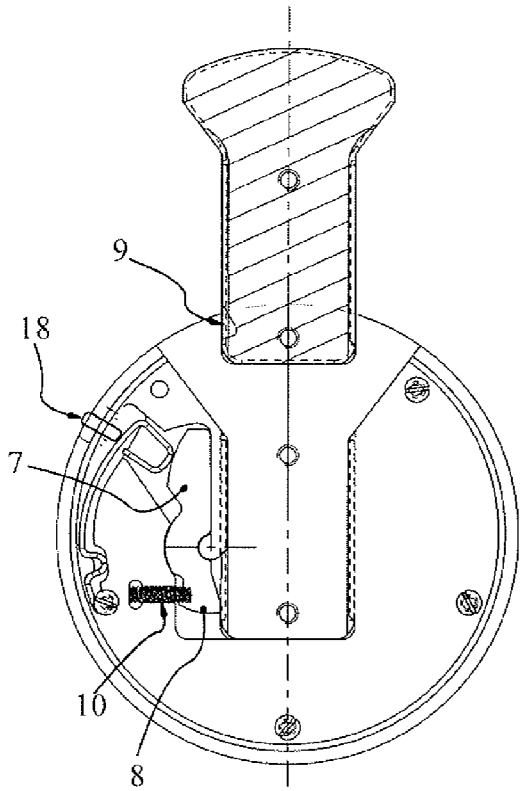
FIG. 8 illustrates the unlocking process.

The means are intended to move from the locked position (FIG. 7) to the unlocked position (FIG. 6). These means are constituted by a resilient bow 14, one end 14*a* of which is immobilized in the locking element and the other end 14*b* of which comprises an unlocking actuation projection 14*c* intended to be in abutment against first arm 7*b* of bolt 7. The bow is constituted by a circular part made of elastically deformable material such as metal or any appropriate material, for example of plastic or composite material.

Note that, advantageously, the device comprises a pushbutton 16 projecting out of the locking element so that it can easily be actuated by the user who, in order to unlock and release the case, simply needs to press down in order to cause pivoting of the movable bolt. Pushbutton 16 is arranged for that purpose in abutment against that end 14*b* of the bow at which unlocking actuation projection 14*c* is located.

Figure 9:
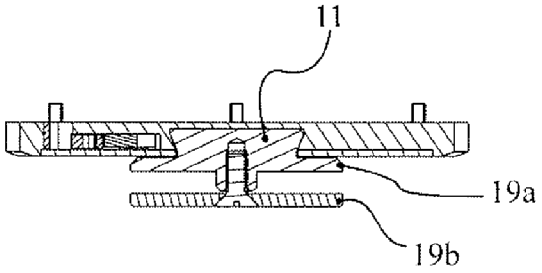
FIG. 9 is a section view along B-B in FIG. 7.

The slide rail system is of the dovetail type, as shown more particularly in FIG. 9. Once locking is effected, the slide rail ensures retention rotationally, in translation, and vertically.

Slider 11 of the hooking element furthermore comprises a substantially rectangular first portion 11*a*, this first portion 11 a interacting with slide rail 12 of the locking element, while said slider comprises a conically shaped second portion 11*b* intended to interact with a corresponding conical cutout 12*b* implemented in the locking element. Note that interaction of the conical portion of the slider with the conical cutout 12*b* ensures stable interaction between the two elements and facilitates engagement of the slider.

Be it noted that the locking element comprises an inner receptacle forming the slider and its conical stabilization and insertion portion, and a lateral cutout 17 in which the movable bolt is received. Note that the central portion of the bolt is guided in a circular receptacle in order to ensure pivoting thereof around axis 15.

Figure 3:
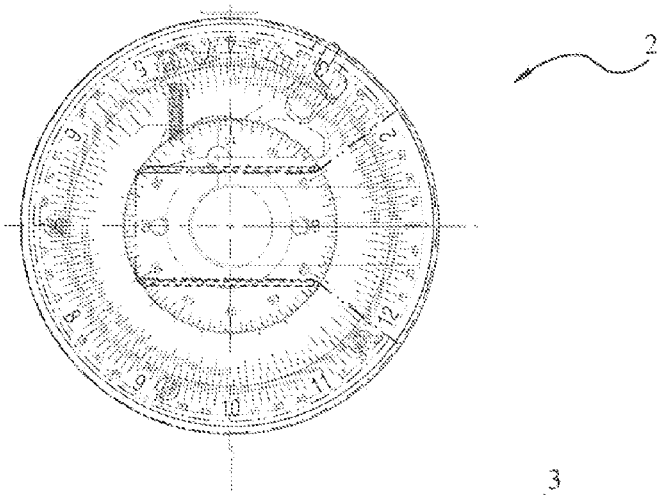
FIG. 3 is a view from above of the watch case disconnected from the band.
Figure 4:
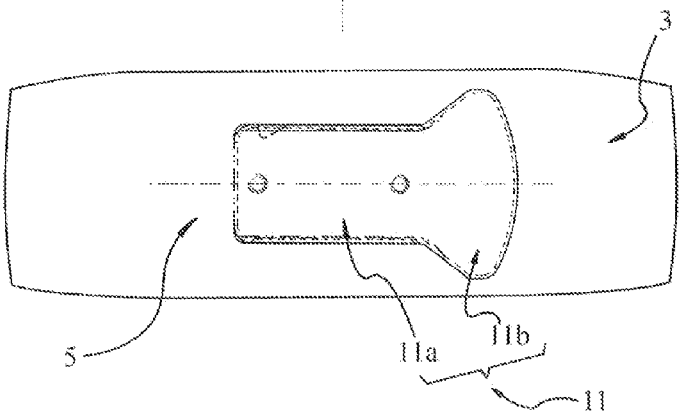
FIG. 4 depicts the band equipped with the element onto which the case becomes fastened.
Figure 5:
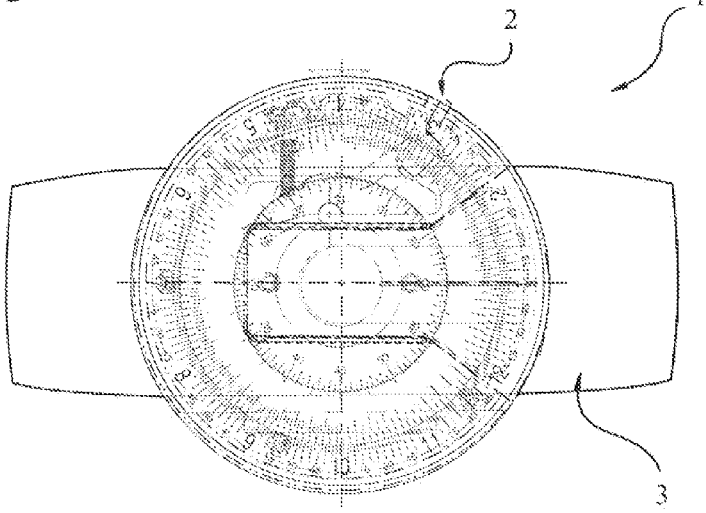
FIG. 5 depicts the watch with its case fastened to the band.

In accordance with the preferred embodiment that is illustrated, the locking element is integral with case 2 while the hooking element is integral with band 3, as illustrated in FIGS. 3, 4, and 5.

According to another embodiment that is not depicted, the locking element is integral with band 3 while the hooking element is integral with case 2.

In order to fasten case 2 onto band 3, the user engages slider 11 into slide rail 12; when insertion is complete, slider 11 pushes hooking projection 8 against the action of resilient system 10 until said projection 8 can sit in recessed profile 9 of the slider in order to ensure locking of case 2 on band 3.

Band 3 is furthermore a flexible strip in a single piece, the ends of which interact with the aid of a clasp 18, which can be of any type, in order to form a closed loop around the wrist.

Figure 10:
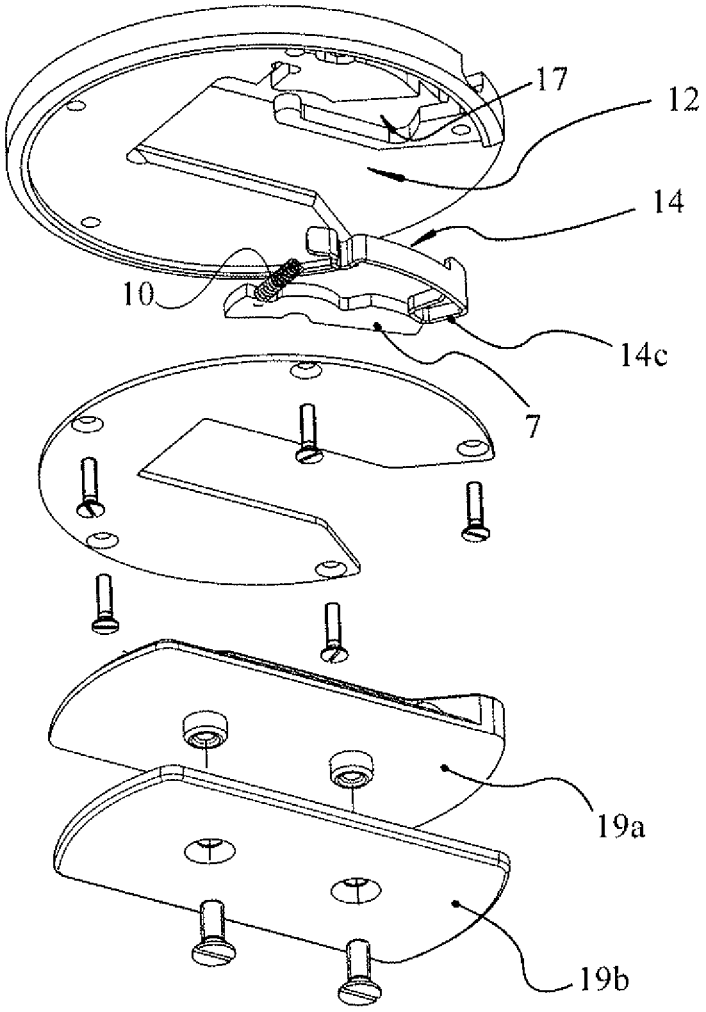
FIG. 10 is an exploded perspective view showing the various elements of the device.

It is evident that the element fastened to the band, whether the hooking element or the locking element, is fastened onto the strap of the band. Fastening of the element to the strap is implemented, for example, by way of two plates 19*a*, 19*b* that sandwich said strap, as is evident in particular from FIG. 10.

The invention claimed is:

1. A watch (1), constituted by a case (2) carried by a band (3); the case (2) is fastened on the band (3) by a removable connection, the latter being constituted by the interaction of two elements (5, 6), namely a first element (5) fastened on the band (3) and a second element (6) integral with the case (2); one of the elements (5, 6) is a hooking element while the other element (6, 5) is a locking element comprising a movable bolt biased by a resilient system (10), coupling it to the hooking element; the hooking element is constituted by a slider (11) intended to interact with a slide rail (12) implemented in the locking element, while the movable bolt (7) comprises a locking projection (8) intended to be engaged into a recessed profile (9) implemented on the slider (11), wherein the movable bolt (7) is mounted in the locking element pivotingly around an axis (15), said bolt being a class 1 lever constituted by a first arm (7*a*) comprising the locking projection and a second arm (7*b*) intended to be biased by unlocking means.

2. The watch (1) according to claim 1, wherein the interaction of the slider (11) with the slide rail (12) is of the dovetail type.

3. The watch (1) according to claim 2, wherein the slider (11) of the hooking element comprises a substantially rectangular first portion (11*a*), that first portion (11*a*) interacting with the slide rail (12) of the locking element, while said slider comprises a conically shaped second portion (11*b*) intended to interact with a corresponding conical cutout (12*b*) implemented in the locking element.

4. The watch (1) according to claim 3, wherein the locking element comprises an inner receptacle forming the slider and its conical stabilization and insertion portion, and a lateral cutout (17) in which the movable bolt is received, the central portion of the bolt being guided in a circular receptacle in order to ensure pivoting thereof around the axis (15).

5. The watch (1) according to claim 3, provided with unlocking means constituted by a resilient bow (14), one end (14*a*) of which is immobilized in the locking element and the other end (14*b*) of which comprises an unlocking actuation projection (14*c*) intended to abut against the second arm (7*b*) of the bolt (7).

6. The watch (1) according to claim 3, wherein the locking element is integral with the case (2) while the hooking element is integral with the band (3).

7. The watch (1) according to claim 2, wherein the locking element comprises an inner receptacle forming the slider and its conical stabilization and insertion portion, and a lateral cutout (17) in which the movable bolt is received, the central portion of the bolt being guided in a circular receptacle in order to ensure pivoting thereof around the axis (15).

8. The watch (1) according to claim 2, provided with unlocking means constituted by a resilient bow (14), one end (14*a*) of which is immobilized in the locking element and the other end (14*b*) of which comprises an unlocking actuation projection (14*c*) intended to abut against the second arm (7*b*) of the bolt (7).

9. The watch (1) according to claim 2, wherein the locking element is integral with the case (2) while the hooking element is integral with the band (3).

10. The watch (1) according to claim 1, wherein the locking element comprises an inner receptacle forming the slider and its conical stabilization and insertion portion, and a lateral cutout (17) in which the movable bolt is received, the central portion of the bolt being guided in a circular receptacle in order to ensure pivoting thereof around the axis (15).

11. The watch (1) according to claim 10, provided with unlocking means constituted by a resilient bow (14), one end (14*a*) of which is immobilized in the locking element and the other end (14*b*) of which comprises an unlocking actuation projection (14*c*) intended to abut against the second arm (7*b*) of the bolt (7).

12. The watch (1) according to claim 10, wherein the locking element is integral with the case (2) while the hooking element is integral with the band (3).

13. The watch (1) according to claim 1, provided with unlocking means constituted by a resilient bow (14), one end (14*a*) of which is immobilized in the locking element and the other end (14*b*) of which comprises an unlocking actuation projection (14*c*) intended to abut against the second arm (7*b*) of the bolt (7).

14. The watch (1) according to claim 13, wherein the locking element is integral with the case (2) while the hooking element is integral with the band (3).

15. The watch (1) according to claim 13, wherein the bow (14) is constituted by a circular part made of elastically deformable material.

16. The watch (1) according to claim 15, wherein the locking element is integral with the case (2) while the hooking element is integral with the band (3).

17. The watch (1) according to claim 15, wherein the locking element comprises a pushbutton (16) projecting out of that locking element to allow easy actuation by the user, who in order to unlock and release the case simply needs to press down in order to cause pivoting of the movable bolt, said pushbutton (16) being arranged in abutment against that end (14*b*) of the bow at which the unlocking actuation projection (14*c*) is located.

18. The watch (1) according to claim 1, wherein the locking element is integral with the case (2) while the hooking element is integral with the band (3).

19. The watch (1) according to claim 1, wherein the locking element is integral with the band (3) while the hooking element is integral with the case (2).

20. The watch (1) according to claim 1, wherein the band (3) is a flexible strip in a single piece, the ends of which interact with the aid of a clasp (18).

* * * * *